US008373524B1

(12) United States Patent
Villarin

(10) Patent No.: US 8,373,524 B1
(45) Date of Patent: Feb. 12, 2013

(54) RELAY CONTACTS CROSS CONNECT MITIGATION

(76) Inventor: Nilo Villarin, Great Falls, VA (US)

( * ) Notice: Subject to any disclaimer, the term of this patent is extended or adjusted under 35 U.S.C. 154(b) by 0 days.

(21) Appl. No.: 13/385,138

(22) Filed: Feb. 4, 2012

(51) Int. Cl.
*H01H 51/22* (2006.01)

(52) U.S. Cl. ..... 335/78

(58) Field of Classification Search ..... 335/78, 335/132, 185
See application file for complete search history.

(56) References Cited

U.S. PATENT DOCUMENTS 2,920,160 A * 1/1960 Heath ..... 335/132
4,691,181 A * 9/1987 Katsutani et al. ..... 335/128
5,329,265 A * 7/1994 Guidi et al. ..... 335/78
5,579,197 A 11/1996 Mengelt
5,701,109 A * 12/1997 Poulsen ..... 335/78
5,703,549 A * 12/1997 Guidi et al. ..... 335/78
5,903,065 A 5/1999 Dragos
6,639,330 B2 10/2003 Villarin
6,661,319 B2 * 12/2003 Schmelz ..... 335/78

* cited by examiner

*Primary Examiner* — Elvin G Enad
*Assistant Examiner* — Alexander Talpalatski
(74) *Attorney, Agent, or Firm* — Roland N. Shubert

(57) ABSTRACT

A double-throw multi-pole power relay switch is modified to meet Underwriters Laboratories standards for a transfer switch that automatically switchs a load from a primary power source to a secondary power source upon interruption of the primary source and without cross connection of the primary and secondary sources in the event that one or more relay switch contacts become welded.

8 Claims, 4 Drawing Sheets

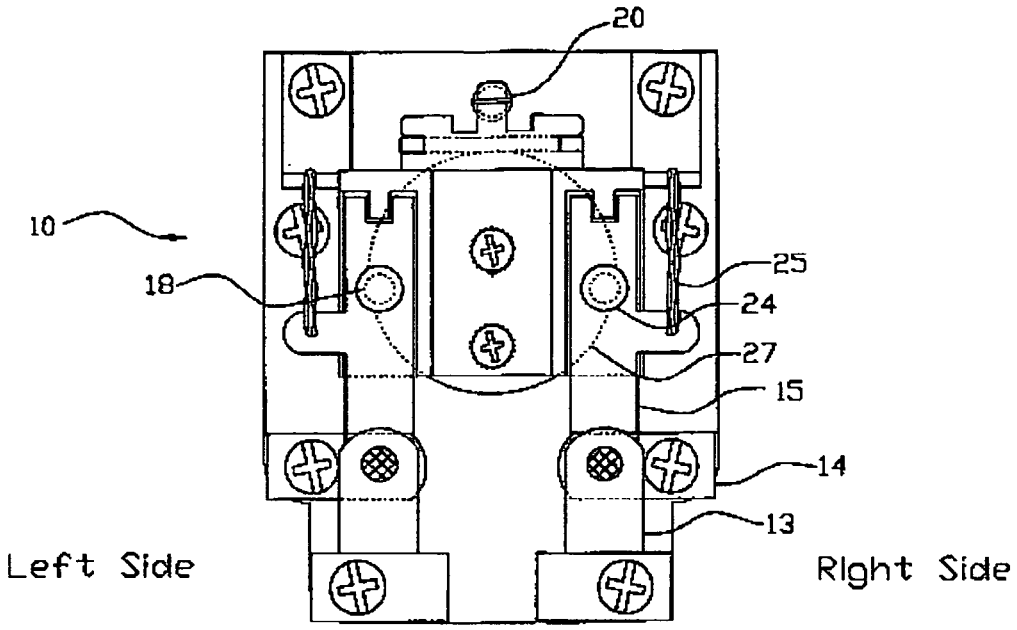
Fig. 1-a
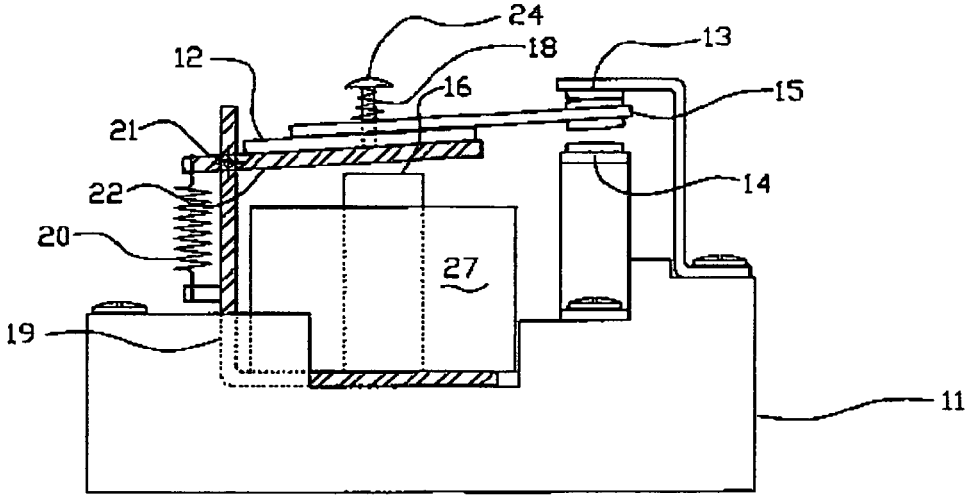
Fig. 1-b

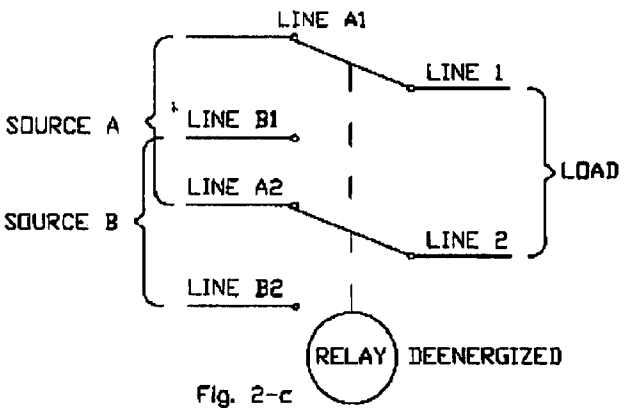
Fig. 2-c
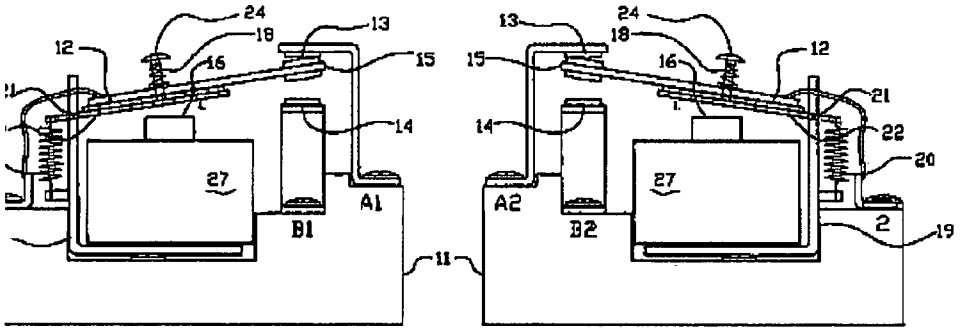
Fig. 2-b
Fig. 2-a
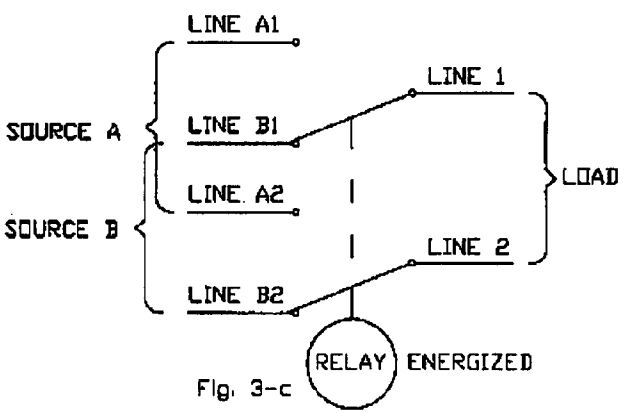
Fig. 3-c
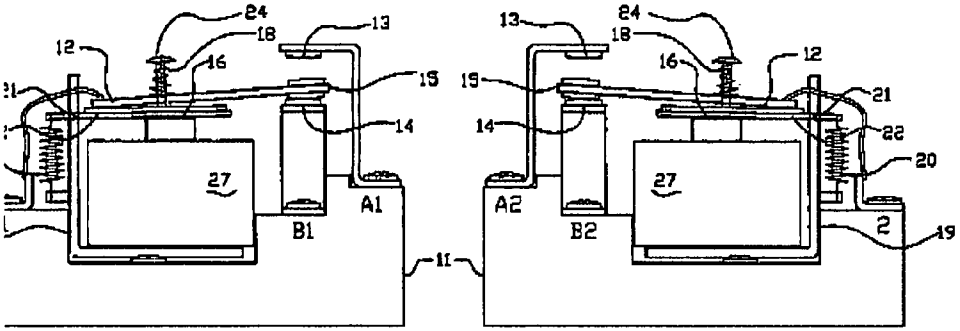
Fig. 3-b
Fig. 3-a

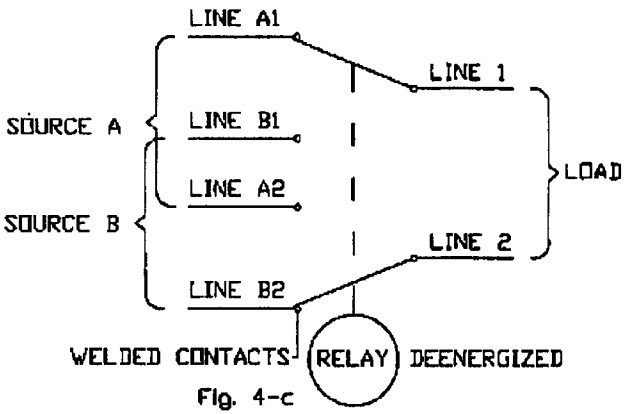
Fig. 4-c
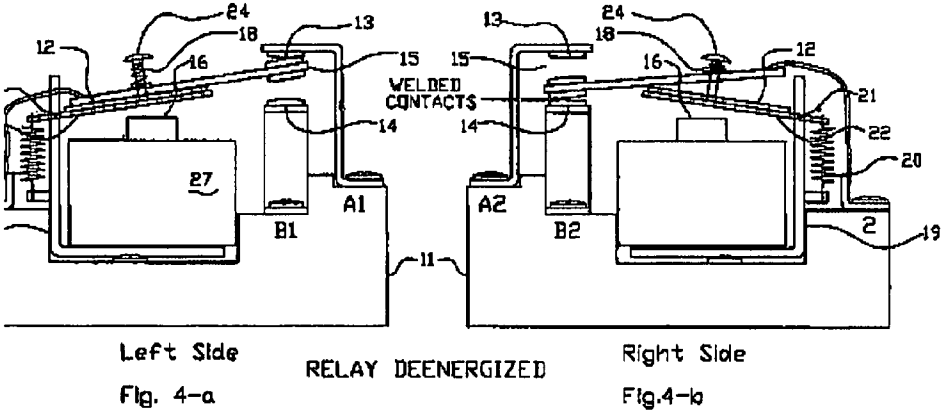
Right Side
Fig. 4-b
RELAY DEENERGIZED
Left Side
Fig. 4-a
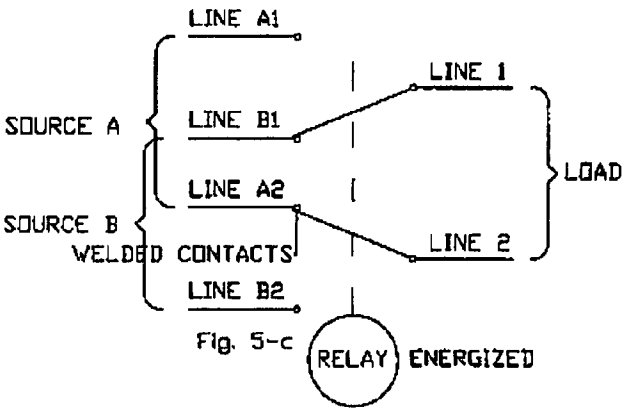
Fig. 5-c
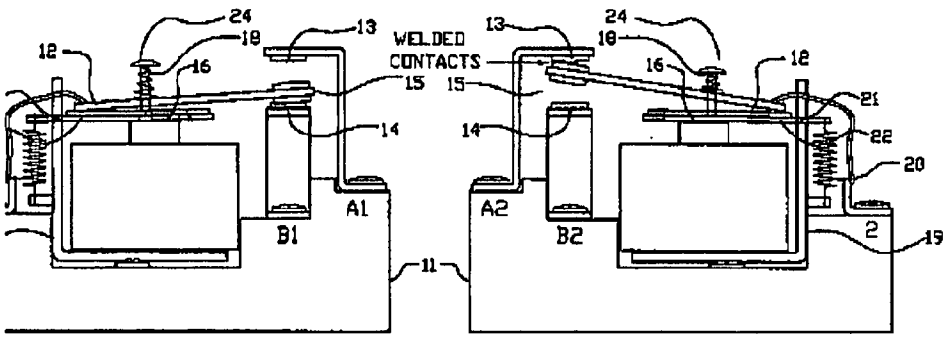
Right Side
Fig. 5-b
RELAY ENERGIZED
Left Side
Fig. 5-a

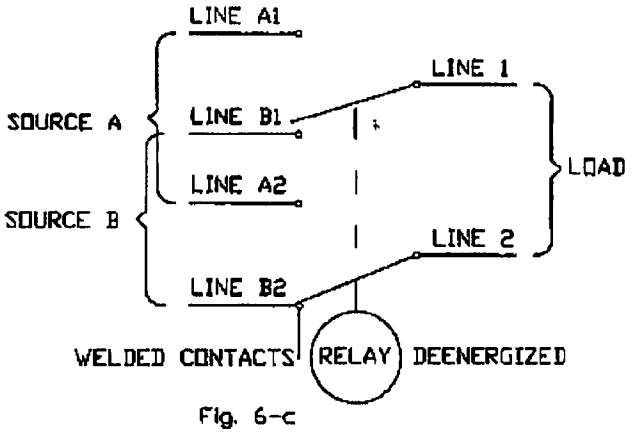
Fig. 6-c
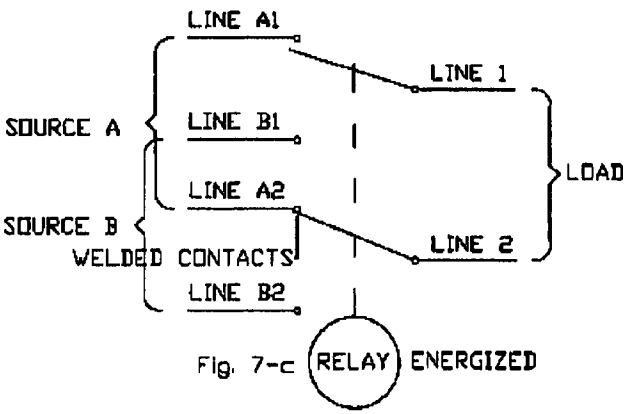
Fig. 7-c
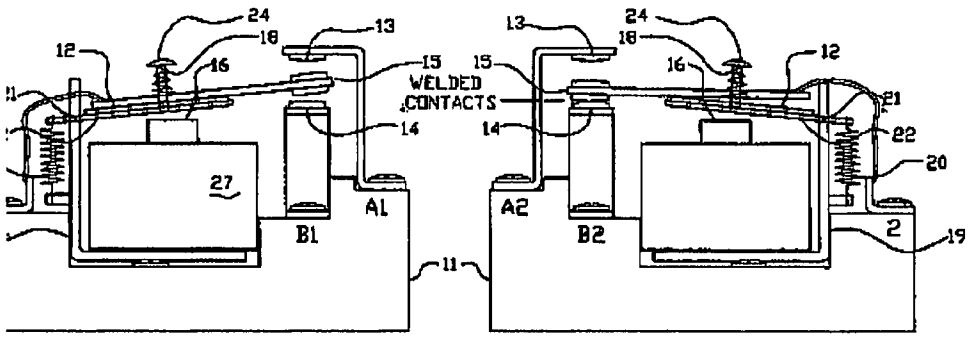
Left Side
Fig. 6-a
Right Side
Fig. 6-b
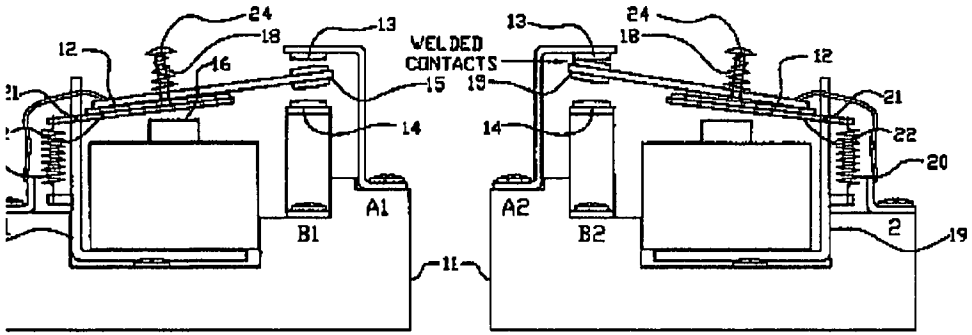
Left Side
Fig. 7-a
Right Side
Fig. 7-b

RELAY CONTACTS CROSS CONNECT MITIGATION

BACKGROUND OF THE INVENTION

1. Technical Field

This invention relates to a transfer switch which is a power switching device that automatically switches a load from a primary power source to a secondary power source upon interruption or loss of the primary power source.

In particular, this invention relates to the modification of a standard double-throw multi-pole power relay switch so that it will meet the standards of Underwriters Laboratories to qualify as a transfer switch and mitigate the problem of cross connection of power sources that results from welding of contacts that may be caused by arcing and vibration. Underwriters Laboratories Standard UL 1008, Clause 22.23 states: "The mechanism and interlocking means shall be constructed to reduce the possibility of transfer in either direction in the event of welding of one or more contacts in the power circuit." At this time, no known commercially available model of open type multi-pole power relay complies with that requirement.

2. Description of Related Art

Systems to restore electrical power to a load in the event of source failure are in common use and necessarily include a primary and a secondary power source, and a means to switch from the primary to the secondary source in case of disruption or failure of the primary source. These systems are often complex and expensive. One example of a backup power system is illustrated by U.S. Pat. No. 5,579,197. Another such system is illustrated by applicant's prior patent, U.S. Pat. No. 6,639,330.

SUMMARY OF THE INVENTION

A conventional double-throw multi-pole power relay switch is modified so that it qualifies as a transfer switch under Underwriters Laboratories standards. The modification consists of replacing the damper spring on each of the moveable contacts of the relay switch with a damper spring having a much greater spring force or stiffness. In all cases, the spring force of the replacement damper spring for a particular movable contact must be sufficient to withstand the pull of the armature return spring for that particular movable contact. In all cases as well, the spring force of the replacement damper spring must also be sufficient to withstand the magnetic attraction exerted by the relay coil. In practice, it has been found that a replacement spring must have a spring force at least five times that of the original, and preferably of at least ten times that of the original. That modification then ensures operation of the relay switch to prevent a cross connection between the primary power source and the secondary, or back-up, power source in the event that there were welded contacts at the time the switch was activated.

BRIEF DESCRIPTION OF THE DRAWINGS

In the drawings:

FIG. 1-*a* is a top view of a typical open-type, multi-pole double-throw power relay showing construction details;

FIG. 1-*b* is a left side view of the relay of FIG. 1-*a;*

FIG. 2-*a* is a left side view of the relay of FIG. 1 with standard damper springs and de-energized;

FIG. 2-*b* is a right side view of the relay of FIG. 2-*a;*

FIG. 2-*c* is a diagram showing connections between two sources and a load when the relay with standard damper springs is de-energized;

FIG. 3-*a* is a left side view of the relay of FIG. 1 with standard damper springs and energized;

FIG. 3-*b* is a right side view of the relay of FIG. 3-*a;*

FIG. 3-*c* is a diagram showing connections between two sources and a load when the relay with standard damper springs is energized;

FIG. 4-*a* is a left side view of the relay of FIG. 1 with standard damper springs, de-energized with welded contacts;

FIG. 4-*b* is a right side view of the relay of FIG. 4-*a;*

FIG. 4-*c* is a diagram showing connections between two sources and a load when the relay with standard damper springs is de-energized and has welded contacts;

FIG. 5-*a* is a left side view of the relay of FIG. 1 with standard damper springs, energized with welded contacts;

FIG. 5-*b* is a right side view of the relay of FIG. 5-*a;*

FIG. 5-*c* is a diagram showing connections between two sources and a load when the relay with standard damper springs is energized and has welded contacts;

FIG. 6-*a* is a left side view of the relay of FIG. 1 with modified damper springs, de-energized with welded contacts;

FIG. 6-*b* is a right side view of the relay of FIG. 6-*a;*

FIG. 6-*c* is a diagram showing connections between two sources and a load when the relay with modified damper springs is de-energized and has welded contacts;

FIG. 7-*a* is a left side view of the relay of FIG. 1 with modified damper springs, de-energized with welded contacts;

FIG. 7-*b* is a right side view of the relay of FIG. 7-*a*; and

FIG. 7-*c* is a diagram showing connections between two sources and a load when the relay with modified damper springs is energized and has welded contacts.

DESCRIPTION OF PREFERRED EMBODIMENTS OF THE INVENTION

With reference to the drawings, and in particular to FIGS. 1-*a* and 1-*b*, there is depicted at 10 a typical open-type, multi-pole double-throw power relay that is capable of handling loads as high as 100 amperes. Metallic parts such as normally closed fixed contact 13, normally open fixed contact 14, iron coil core 16, and magnetic iron structure 19 are mounted on an insulating base 11 fabricated from a plastic material such as Bakelite or phenol-formaldehyde resin.

When the relay coil 27 is not energized, the insulating armature 12 and magnetic armature 22 rotate upward about armature hinge 21 and are held in that position by the tension of the armature return spring 20. Each of the common (movable) contact springs 15 is seated on an insulating armature and is held in place by the compression force of the damper springs 18 so as to make contact with the normally closed (fixed) contacts 13. Upon energizing the coil 27 the armature assembly, which comprises insulating armature 12 and magnetic armature 22, is attracted to the face of coil core 16 breaking the connections of the common (movable) contact springs with the normally closed (fixed) contacts 13 and transferring their connections to the normally open (fixed) contacts 14.

FIGS. 2-*a* and 2-*b* show the left and right side views respectively of the relay using its original standard damper springs and in a de-energized state along side its corresponding schematic diagram, FIG. 2-*c*. That schematic diagram shows the load connected to lines A1 and A2 of power source A. Similarly, FIGS. 3-*a* and 3-*b* show the left and right side views respectively of that same relay with original damper springs but in an energized state together with its corresponding schematic diagram, FIG. 3-*c*. In this arrangement, the relay is utilized to switch the power source to the load between source A and source B. With the relay de-energized the load is connected to line A1 and line A2 of source A, and when energized, transfers the load to line B1 and B2 of source B. This is the normal operation of a double-pole double-throw relay.

FIGS. 4-*a* and 4-*b* show the left and right side views respectively of the same relay employing standard damper springs but with a welded contact of one of the movable contact springs. In this illustration the movable contact spring of line 2 became welded, usually by arcing, to the contact of line B2 while it had been in the energized state resulting in a connection between source line A1 and load line 1, and between source line B2 and load line 2, see the FIG. 4-*c* diagram. After a contact spring becomes welded and the relay is subsequently de-energized, the armature return spring 20 will pull the end of the magnetic armature 22 and rotate the armature assembly upwardly. That, in turn, pushes upon the welded movable contact spring 15 compressing its damper spring 18: see FIG. 4-*b*. The common movable contact spring of line 1 is free to move and transfers to line A1 of source A; see FIG. 4-*a*. Because the line 2 movable contact is welded, it stays connected to line B2 of source B, That creates a cross connection between source A and source B resulting in a malfunction of the entire system.

As is shown in FIGS. 5-*a*, 5-*b* and 5-*c*, a similar situation arises if the common (movable) contact 15 of line 2 gets welded to the contact of line A2 while the relay is de-energized and is subsequently energized. Upon energizing the coil 27 the pole (core) face 16 will attract the armature assembly along with the shoulder rivet 24, compressing the damper spring 18 of the welded common (movable) contact spring 15 as is best seen in FIG. 5-*b*. The common (movable) contact spring 15 of line 1 that is not welded is free to move and transfers to line B1 of source B; see FIG. 5-1. Line 2, whose contact is welded, stays connected to line A2 of source A. Again this is a cross-connect condition between source A and source B resulting in a malfunction of the system.

FIGS. 6-*a*, 6-*b*, and 6-*c* illustrate in a left side view the relay in the de-energized state, having a welded contact, and equipped with modified damper springs as taught in this invention. Similarly, FIGS. 7-*a*, 7-*b*, and 7-*c* illustrate in a right side view that same relay in the energized state, having a welded contact, and equipped with the modified damper springs of this invention. As has been set out previously, the modified damper springs have a much higher compression characteristic than do the original and standard springs. For example, were one of the common movable contact springs 15 of line 2 to become welded to the contact of line B2 of source B while the relay is in the energized state and is subsequently de-energized, the armature return spring 20 will try to pull the end of the magnetic armature so as to rotate the armature assembly upwardly. The high compression characteristic of the damper spring 18 will then prevent the armature assembly from returning to its de-energized position as is best illustrated in FIG. 6-*b*. Thus, there is no change in the electrical state of the movable contacts and therefore no cross connection between source A and source B will occur.

Referring now to FIGS. 7-*a*, 7-*b*, and 7-*c*, a similar situation arises if the common (movable) contact spring 15 of line 2 gets welded to the contact of line A2 while the relay is de-energized and subsequently energized. In this circumstance the pole (core) face 16 will try to attract the armature assembly and shoulder rivet 24. As is best illustrated in FIG. 7-*b*, the high compression characteristic of the damper springs employed in this invention overcomes the attraction of the pole face to prevent the armature assembly from moving down. Thus, there is no change in the electrical state of the movable contacts and therefore no cross connection between source A and source B will occur.

In an exemplary modification of a standard double-throw multi-pole power relay, the original damper springs were removed and their characteristics were measured. The uncompressed free length of a damper spring was 0.5 inch and its fully compressed length was 0.2 inch. Force required to compress the spring was 0.24 lb giving an average spring force of 0.81 lb per inch. The original damper springs were replaced with new springs having an uncompressed length of 0.31 inch and a compressed length of 0.19 inch. Force required to compress the spring was 1.26 lb giving an average spring force of 10.5 lb per inch, which is more than 10-fold greater than the spring force of the original spring. The modified relay was tested and it operated as described herein.

It is understood that the described invention includes all those modified forms of the specific embodiments described herein and includes as well all such embodiments that come within the scope of the following claims.

I claim:

1. A double-throw multi-pole power relay switch that is modified to function as a transfer switch in the automatic switching of a load from a primary power source to a secondary power source in the event that the primary source is interrupted, comprising:

providing a conventional double-throw multi-pole power relay switch, said relay switch having a plurality of moveable contacts, each movable contact being mounted upon a magnetic armature and held in place by a damper spring, a coil and coil core which when the coil is energized, attracts the magnetic armature causing it to overcome the tension of an armature return spring, said damper spring having a spring force sufficient to overcome the magnetic attraction of the coil and coil core when the coil is energized so as to prevent cross connection between the primary power source and the secondary power source in the event that contacts in the power relay switch become welded.

2. The power relay switch of claim 1 wherein the spring force of said damper spring is sufficient as well to overcome the tension exerted by the armature return spring.

3. In a conventional double-throw multi-pole power relay switch that is employed to automatically switch a load from a primary power source to a secondary power source upon interruption of the primary power source, the power relay having a plurality of moveable contacts, each movable contact mounted upon a magnetic armature and held in place by a damper spring, a coil and coil core which when the coil is energized, attracts the magnetic armature causing it to overcome the tension of an armature return spring; the improvement comprising:

replacing the original damper springs with springs having a substantially greater spring force, that greater spring force being sufficient to overcome the magnetic attraction of the coil and coil core when the coil is energized, and sufficient as well to overcome the tension exerted by the armature return spring, whereby cross connection between the primary power source and the secondary power source is prevented in the event that one or more contacts in the power relay switch become welded.

4. In a conventional double-throw multi-pole power relay switch that is employed to automatically switch a load from a primary power source to a secondary power source upon interruption of the primary power source, the power relay having a plurality of moveable contacts, each movable contact mounted upon a magnetic armature and held in place by a damper spring, a coil and coil core which when the coil is energized, attracts the magnetic armature causing it to overcome the tension of an armature return spring; the improvement comprising:

replacing the original damper springs with springs having a substantially greater spring force, that greater spring force being sufficient to overcome the magnetic attraction of the coil and coil core when the coil is energized, and sufficient as well to overcome the tension exerted by the armature return spring, whereby cross connection between the primary power source and the secondary power source is prevented in the event that one or more contacts in the power relay switch become welded.

5. The power relay switch of claim 4 wherein the replacement damper springs have a spring force at least five times the spring force of the original damper springs.

6. The power relay switch of claim 4 wherein the replacement damper springs have a spring force at least ten times the spring force of the original damper springs.

7. A method for preventing cross connection between a primary power source and a secondary power source when automatically switching a load from the primary power source to the secondary power source in the event that the primary power source is interrupted, comprising:

employing a double-throw multi-pole relay to perform said load switching, said relay having a plurality of moveable contacts, each movable contact being mounted upon a magnetic armature and held in place by a damper spring, a coil and coil core which when the coil is energized, attracts the magnetic armature causing it to overcome the tension of an armature return spring, said damper spring having a spring force sufficient to overcome the magnetic attraction of the coil and coil core when the coil is energized thereby preventing cross connection between the primary power source and the secondary power source in the event that contacts in the relay become welded.

8. The method of claim 7 wherein the spring force of said damper spring is sufficient as well to overcome the tension exerted by the armature return spring.

* * * * *